US010519385B1

(12) United States Patent
Green et al.

(10) Patent No.: US 10,519,385 B1
(45) Date of Patent: Dec. 31, 2019

(54) UPGRADING JET FUEL USING SPENT FCC EQUILLIBRUIM CATALYST

(71) Applicant: PHILLIPS 66 COMPANY, Houston, TX (US)

(72) Inventors: John B. Green, Bartlesville, OK (US); Cory B. Phillips, Roselle Park, NJ (US); Laura Lee Young, Bartlesville, OK (US); Swati Thakur, Sayreville, NJ (US); Leonard Nyadong, Owasso, OK (US)

(73) Assignee: Phillips 66 Company, Houston, TX (US)

( * ) Notice: Subject to any disclaimer, the term of this patent is extended or adjusted under 35 U.S.C. 154(b) by 0 days.

(21) Appl. No.: 16/219,212

(22) Filed: Dec. 13, 2018

(51) Int. Cl.

| | |
|---|---|
| ***C10G 25/03*** | (2006.01) |
| ***C10G 25/12*** | (2006.01) |
| ***C10L 9/10*** | (2006.01) |
| ***C10L 1/12*** | (2006.01) |

(52) U.S. Cl.
CPC ..... *C10G 25/03* (2013.01); *C10G 25/12* (2013.01); *C10L 1/1233* (2013.01); *C10L 9/10* (2013.01); *C10G 2300/1051* (2013.01); *C10G 2300/701* (2013.01); *C10G 2400/08* (2013.01); *C10L 2200/029* (2013.01); *C10L 2200/043* (2013.01); *C10L 2230/04* (2013.01); *C10L 2270/04* (2013.01)

(58) Field of Classification Search
None
See application file for complete search history.

(56) References Cited

U.S. PATENT DOCUMENTS

| | | | | |
|---|---|---|---|---|
| 5,972,201 | A * | 10/1999 | Goolsby | C10G 11/02 208/106 |
| 2009/0065400 | A1* | 3/2009 | Song | B01D 53/02 208/243 |

* cited by examiner

*Primary Examiner* — Tam M Nguyen
(74) *Attorney, Agent, or Firm* — Phillips 66 Company

(57) ABSTRACT

Spent zeolite equilibrium catalyst from the fluidized catalytic cracker has a useful function as an adsorbent for jet fuel. Redirecting such spent catalyst saves costs for refinery operations in two ways. The first is by avoiding the costs for disposing of such catalyst as hazardous waste. The second is to reduce the cost of procuring sorbent for the jet fuel decontamination process. Since zeolite is primarily silica and conventional sorbents are also silica, zeolite catalysts are chemically similar. And the equilibrium catalyst may be regenerated in the FCC after its becomes saturated with jet fuel contaminants and re-used.

6 Claims, No Drawings

UPGRADING JET FUEL USING SPENT FCC EQUILLIBRUIM CATALYST

CROSS-REFERENCE TO RELATED APPLICATIONS

None.

STATEMENT REGARDING FEDERALLY SPONSORED RESEARCH OR DEVELOPMENT

None.

FIELD OF THE INVENTION

This invention relates to refining hydrocarbons and particularly to operating refineries to produce high quality fuels at lowest practical costs and more particularly making high quality jet fuel at the lowest practical cost.

BACKGROUND OF THE INVENTION

Considerable effort has been expended to identify the characteristics of quality jet fuel that is safe and reliable for jet plane transportation. The critical test for jet fuel is the JFTOT or Jet Fuel Thermal Oxidation Test and the process for such testing is described in ASTM Standard D3241. Consider that the fuel must be refined, shipped, stored, and transferred to airplanes on the ground at ordinary conditions, but also must remain stable, water free and reliable at low pressure and the ultra-low temperatures of high altitude flight prior to being subject to very high temperatures in the fuel delivery system to the jet engine. So, low oxidative thermal stability makes jet fuel vulnerable to forming precipitates in the fuel delivery system which may lead restrictions and blockages of flow. Low thermal stability of jet fuel is simply unacceptable. Low thermal stability is caused by contamination of certain organic compounds such as olefins and heterocyclic compounds along with metals including copper and zinc among others.

The conventional non-hydrotreating based procedures for removing these contaminants is by passing the raw kerosene or jet fuel through a sorbent drum filled with a silica or clay sorbent. The sorbent captures and adheres to both the organic and metallic contaminants. However, in time, the sorbent becomes saturated and its adsorbent capacity is used up, the contaminants begin to pass through the drum with the jet fuel. The finishing or polishing of the jet fuel is incomplete and the adsorbent must be replaced prior to such contamination break through. The sorbent, once saturated with these chemicals, is typically disposed as hazardous material which can be very expensive. The sorbent is sufficiently special to not be inexpensive, but the cost of disposal as a hazardous waste adds considerably to the cost of producing finished jet fuel.

While any replacement process for cleaning up the residual contaminants in jet fuel must be able to perform that function as well as the current process, but any cost savings within the clay sorbent life-cycle would be valuable and durable to refiners.

BRIEF SUMMARY OF THE DISCLOSURE

The invention more particularly relates to a process for finishing raw kerosene in a refinery to remove organic and metallic contaminants and produce finished, on spec the jet fuel. The process includes producing a kerosene cut in the refinery and recovering equilibrium zeolite catalyst from a fluidized catalytic cracker in the refinery. A decontamination vessel is set up for adsorbing contaminants from the kerosene cut produced in the refinery where recovered equilibrium zeolite catalyst is added from the fluidized catalytic cracker into the decontamination vessel for decontamination of the kerosene and the kerosene is passed through the decontamination vessel so that the recovered equilibrium catalyst adsorbs contaminants therefrom to produce finished and polished on spec jet fuel.

In a particular advantage of the present invention, when the equilibrium catalyst becomes less capable of adsorbing the contaminants in the jet fuel, it is regenerated in the fluidized catalytic cracker and used again for adsorbing contaminants.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

As it relates to passing jet fuel over an adsorbent to remove constituents that tend to cause failure of the JFTOT test, the inventors have noted that there is another major process within most refineries that also employs a silica-based material. This major process is a fluidized catalytic cracker (often called an FCC") and uses silica-based catalyst to convert heavier molecular weight hydrocarbons to gasoline materials. The silica material used in the FCC is often is a rather expensive zeolite catalyst (sometimes called an Equilibrium Catalyst or "ECAT") and considering how much profit a refinery derives from the operation of an FCC, there is considerable tolerance for paying high dollars for the most productive and long-life catalysts available for squeezing the most profit out of an FCC. Using expensive zeolite catalyst in a sorbent process for jet fuel would be out of the question and never considered except for the curiosity and creativity of the inventors taking note of the chemical similarity to the sorbents for jet fuel. However, FCC zeolite catalyst, while regenerated multiple times both on site and off site eventually wear out. Catalyst attrition is a second cause for zeolite catalyst loss.

Zeolite fines, less than about 250 microns, ironically turns out to be roughly the same particle size as the silica sorbent used in jet fuel decontamination. So, the question is whether such spent catalyst and especially the fines would function as a jet fuel sorbent without releasing other undesirable materials into the jet fuel. It turns out that an otherwise waste product from FCC operations are functional and helpful in the decontamination of jet fuel. Even more remarkable is that the zeolite equilibrium catalyst, once saturated with materials in raw jet fuel that would otherwise cause failure of the JFTOT test are not a problem that requires disposal as the hazardous waste that current sorbent use requires. The adsorbed materials are suitable or at least not problematic for being burnt off in the regeneration process of the FCC where coke is burnt off the active FCC catalyst.

Actually, a FCC uses a large volume of catalyst in a continuous loop where it performs a catalytic reaction for a number of seconds and then is regenerated at the higher temperature regeneration process and the amount of FCC catalyst used as a sorbent for jet fuel is quite small, the sorbent can be added to the FCC and the otherwise hazardous material is combusted to flue gases. A portion of the undersized catalyst materials from the FCC are recovered (some may be new to the sorbent process and some may not, and the volumes and characteristics make them indistinguishable from one another). Regardless, paying expensive fees for disposing of hazardous waste is avoided.

The process for treating the jet fuel is fairly simple in that the adsorbent is added to a drum or vessel, perhaps activated for adsorbing contaminants by heating and then the on-spec jet fuel is added to the vessel so that any initial draw from the vessel will be on-spec jet fuel. An initial flow that is directed in to the vessel is also on-spec and then the raw jet or kerosene is directed to the decontamination vessel to begin the adsorption of contaminants and production of finished, polished and on-spec jet fuel. The flow through the vessel generally occurs at ambient pressure and temperature and continues until the color of the jet fuel coming out of the vessel starts to reveal that the adsorbent has become saturated and out of capacity to capture sufficient amounts of the contaminants.

The contaminants, it should be understood are the components in the raw jet fuel that are less oxygen stable at elevated temperatures. Optimal jet fuel is light straight run within a well-defined molecular weight range that begins as a kerosene cut from one or more fractionators in the refinery. All hydrocarbons oxidize including light straight run. Some hydrocarbons are prone to oxidize at lower temperatures and those species should only be in jet fuel at very small concentrations. Water and surfactants are also a significant concern in jet fuel. The numbers and types of molecules that may cause prospective jet fuel to fail to meet spec are numerous, but there is an affinity of these materials for high surface area sorbents that attach easily to polar function/Lewis base function species. What doesn't adsorb tends to pass the jet specifications and make raw jet or kerosene into useful and salable jet fuel.

The equilibrium catalyst would be removed from the adsorbent vessel and, in accordance with the present invention, regenerated. Preferably, there would be multiple vessels for treating or decontaminating jet fuel and would preferably be arranged in series such that the kerosene would pass through the "youngest" or most recently regenerated batch of equilibrium catalyst last in the series.

Regeneration occurs in the fluidized catalytic cracker. Preferably, the sorbent catalyst, even though undersized, would be added to the FCC with new or fresh catalyst and pass through both the regeneration system and the catalytic reactor until it is separated as being undersized. The undersized catalyst is captured to be re-used as jet fuel sorbent and disposal of the conventional jet sorbent as hazardous material would be suspended permanently thereby reducing significant cost for producing jet fuel.

Tests showing the performance of spent equilibrium zeolite catalyst are shown in Table 1 below:

TABLE 1

| Sample | Grams Used | Break-through Volume, (L) | Saybolt Color at Break-through | Capacity (L/g) | Capacity (Bbl/lb) |
|---|---|---|---|---|---|
| Clay | 21 | 2.473 | 27 | 0.118 | 0.336 |
| Charcoal | 13.1 | 2.519 | 17 | 0.192 | 0.549 |
| Commercial Silica Sorbent | 15.6 | 2.501 | 23 | 0.160 | 0.457 |

TABLE 1-continued

| Sample | Grams Used | Break-through Volume, (L) | Saybolt Color at Break-through | Capacity (L/g) | Capacity (Bbl/lb) |
|---|---|---|---|---|---|
| Spent ECAT | 32.3 | >8 | Not Available | Not Available | Not Available |
| Spent ECAT Blend w/ Charcoal | 32.3 | >10 | Not Available | Not Available | Not Available |

Table 1 summarizes salient results from the tests where the sorbents were packed in a cylindrical vessel and a volume of off-spec jet fuel was allowed to percolate through the vessel at ambient pressure and temperature. The test jet fuel would not pass the JFTOT using conventional clay. The breakthrough volume is the volume that initially passes the JFTOT test and then no longer passes. As can be seen, only about 2.5 liters of jet passes the test using conventional materials. The FCC ECAT produces much more impressive volume of on-spec jet fuel. As mentioned above, once it is saturated and no longer adsorbs sufficient impurities, it may be regenerated at the FCC and returned for more jet fuel treatment.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein such as in the areas of zeolite equilibrium catalyst composition, sorbent bed configuration, mixed clay/zeolite arrangements. These are all foreseeable incremental improvements of this invention.

It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A process for finishing raw kerosene in a refinery to remove organic and metallic contaminants and produce finished, on-spec the jet fuel, where the process comprises:

producing a kerosene cut in the refinery, providing a fluidized catalytic cracker in the refinery;

recovering equilibrium zeolite catalyst from the fluidized catalytic cracker in a refinery;

providing a decontamination vessel for adsorbing the contaminants from the kerosene cut produced in the refinery;

adding recovered equilibrium zeolite catalyst from the fluidized catalytic cracker into the decontamination vessel for decontamination of the kerosene; and passing the kerosene through the decontamination vessel so that the recovered equilibrium catalyst adsorbs the contaminants therefrom to produce finished and polished on-spec jet fuel.

2. The process according to claim 1 wherein the process more particularly comprises capturing zeolite catalyst fines and using those fines in the decontamination vessel.

3. The process according to claim 1 wherein the process more particularly comprises selecting only spent zeolite fluidized catalytic cracker catalyst in the decontamination vessel.

4. The process according to claim 1 wherein the process further includes the process of sizing the recovered zeolite catalyst to a particle size of less than about 300 microns prior to adding the same into the decontamination vessel.

5. The process according to claim 1 wherein the process further includes the process of activating the recovered zeolite catalyst prior to adding the same into the decontamination vessel by heating the zeolite.

6. The process according to claim 1 wherein the process further includes the step of regenerating the equilibrium catalyst in the fluidized catalytic cracker to burn off the contaminants and return the regenerated equilibrium catalyst to the decontamination vessel for further decontamination of the kerosene to produce finished jet fuel.

* * * * *